US010482866B2

(12) United States Patent
Benway et al.

(10) Patent No.: US 10,482,866 B2
(45) Date of Patent: Nov. 19, 2019

(54) MASKING OPEN SPACE NOISE USING SOUND AND CORRESPONDING VISUAL

(71) Applicant: Plantronics, Inc., Santa Cruz, CA (US)

(72) Inventors: Evan Harris Benway, Santa Cruz, CA (US); Kwangsee Allen Woo, Scotts Valley, CA (US); Dolores Frances Nelson, San Jose, CA (US); Ken Kannappan, Palo Alto, CA (US)

(73) Assignee: Plantronics, Inc., Santa Cruz, CA (US)

( * ) Notice: Subject to any disclaimer, the term of this patent is extended or adjusted under 35 U.S.C. 154(b) by 82 days.

(21) Appl. No.: 15/233,511

(22) Filed: Aug. 10, 2016

(65) Prior Publication Data

US 2016/0351181 A1 Dec. 1, 2016

Related U.S. Application Data

(63) Continuation of application No. 14/136,372, filed on Dec. 20, 2013, now Pat. No. 9,445,190.

(51) Int. Cl.

| | |
|---|---|
| ***H04R 3/02*** | (2006.01) |
| ***G10K 11/175*** | (2006.01) |
| ***H04R 3/00*** | (2006.01) |
| ***H04K 3/00*** | (2006.01) |
| ***H04R 1/32*** | (2006.01) |
| ***H04K 1/04*** | (2006.01) |

(52) U.S. Cl.

CPC ..... *G10K 11/175* (2013.01); *H04K 1/04* (2013.01); *H04K 3/43* (2013.01); *H04K 3/825* (2013.01); *H04K 3/84* (2013.01); *H04R 1/323* (2013.01); *H04R 3/00* (2013.01); *H04R 3/002* (2013.01); *H04K 3/46* (2013.01); *H04K 2203/12* (2013.01); *H04R 2430/00* (2013.01)

(58) Field of Classification Search

CPC ..... G10K 11/175; H04K 3/825; H04R 1/323

See application file for complete search history.

(56) References Cited

U.S. PATENT DOCUMENTS

| | | | | |
|---|---|---|---|---|
| 4,215,500 | A | 8/1980 | Sharp | |
| 5,304,112 | A | 4/1994 | Mrklas | |
| 6,176,027 | B1 * | 1/2001 | Blount | B05B 17/085 40/406 |
| 7,749,155 | B1 | 7/2010 | Anderson | |
| 8,116,461 | B2 | 2/2012 | L'Esperance et al. | |
| 2002/0070284 | A1 * | 6/2002 | Hall | B05B 17/08 239/17 |
| 2003/0010345 | A1 | 1/2003 | Koblasz | |
| 2003/0103632 | A1 | 6/2003 | Goubran et al. | |

(Continued)

OTHER PUBLICATIONS

Unknown, "Noise Masking—Sleeping and Snoring Relief," found at URL <http://www.earplugstore.com/noise-masking.html> on Apr. 7, 2014.

(Continued)

*Primary Examiner* — Simon King

(74) *Attorney, Agent, or Firm* — Chuang Intellectual Property Law

(57) ABSTRACT

Methods and apparatuses for addressing open space noise are disclosed. In one example, a method for masking open space noise includes outputting from a speaker a speaker sound corresponding to a flow of water, and displaying a water element system, the water element system generating a sound of flowing water.

19 Claims, 10 Drawing Sheets

(56) References Cited

U.S. PATENT DOCUMENTS

| | | | | |
|---|---|---|---|---|
| 2003/0107478 | A1* | 6/2003 | Hendricks | G10K 11/175 340/311.2 |
| 2004/0146168 | A1 | 7/2004 | Goubran et al. | |
| 2005/0122592 | A1 | 6/2005 | McKnight | |
| 2007/0133832 | A1 | 6/2007 | DiGiovanni | |
| 2007/0161425 | A1 | 7/2007 | Yamaya | |
| 2008/0071136 | A1 | 3/2008 | Oohashi | |
| 2008/0243211 | A1 | 10/2008 | Cartwright et al. | |
| 2010/0016753 | A1* | 1/2010 | Firlik | A61B 5/0006 600/545 |
| 2010/0086137 | A1 | 4/2010 | Nicolina, Jr. et al. | |
| 2010/0086138 | A1 | 4/2010 | Nicolina, Jr. et al. | |
| 2010/0086139 | A1 | 4/2010 | Nicolina, Jr. et al. | |
| 2010/0086141 | A1 | 4/2010 | Nicolina, Jr. et al. | |
| 2010/0110072 | A1 | 5/2010 | Nakayama | |
| 2011/0002477 | A1* | 1/2011 | Zicknnantel | G10K 11/175 381/73.1 |
| 2011/0071340 | A1* | 3/2011 | McGuire | A61M 21/00 600/28 |
| 2011/0214320 | A1 | 9/2011 | Glickson et al. | |
| 2012/0016926 | A1 | 1/2012 | Toga | |
| 2013/0259254 | A1 | 10/2013 | Xiang et al. | |
| 2014/0104034 | A1* | 4/2014 | Ambrefe, Jr. | G07C 9/00087 340/4.4 |
| 2016/0050738 | A1* | 2/2016 | Bulut | H05B 37/0209 315/158 |

OTHER PUBLICATIONS

Gang et al., "Using Real-Time Adaptive Noise Masking to Mitigate Ambient Interferences," IEEE International Conference on Consumer Electronics (ICCE), pp. 409-410, 2011.

Haapakangas et al., "Effects of Five Speech Masking Sounds on Performance and Acoustic Satisfaction. Implications for Open-Plan Offices," Acta Acustica United with Acustica, 97:641-655, 2011.

Unknown, "White Noise CDs—White Noise Machines & Sound Masking," found at URL <http://www.earplugstore.com/whitenoisecds1.html> on May 12, 2014.

Unknown, "Play Instructions for Maximum Effectiveness of Pure White Noise®," found at URL <https://www.purewhitenoise.com/t-instructions.aspx> on Apr. 7, 2014.

Tart, "An Inexpensive Masking Noise Generator: Monaural or Stereo," Psychophysiology, 2:170-172 (1965).

Unknown, "Sound+Sleep," found at URL <https://soundofsleep.com/> on Jan. 31, 2014.

Unknown, "ASTI Adaptive Sound Sleep Therapy System™ Owner's Manual," Adaptive Sound Technologies, Inc., pp. 1-12, 2011, found at URL <http://soundofsleep.com/wp-content/uploads/2011/08/SoundSleep_Manual.pdf>.

Unknown, "Soft dB Active Volume Control," accessed at URL <http://www.softdb.com/sound-masking-information-active-control.php> on Feb. 13, 2014.

Unknown, "HermanMIller Resolve System," accessed at URL <http://www.hermanmiller.com/content/dam/hermanmiller/documents/product_literature/brochures/Resolve_System_brochure.pdf> on Feb. 13, 2014.

PCT International Search Report and Written Opinion of the International Searching Authority dated Mar. 30, 2015 in international application No. PCT/US2015/070582.

PCT Written Opinion of the International Preliminary Examining Authority dated Dec. 4, 2015 in international application No. PCT/US2014/070582.

PCT International Preliminary Report on Patentability dated Apr. 22, 2016 in international application No. PCT/US2014/070582.

European Search Report and Examination Report issued in corresponding EP Application No. EP 18176338, dated Sep. 26, 2018 (7 pages).

* cited by examiner

MASKING OPEN SPACE NOISE USING SOUND AND CORRESPONDING VISUAL

CROSS-REFERENCE TO RELATED APPLICATION

This application is a continuation of co-pending U.S. Utility patent application Ser. No. 14/136,372, filed Dec. 20, 2013, and titled "Masking Open Space noise Using Sound and Corresponding Visual," the disclosure of which is incorporated herein by reference in its entirety.

BACKGROUND OF THE INVENTION

Noise within an open space is problematic for people working within the open space. For example, many office buildings utilize a large open office area in which many employees work in cubicles with low cubicle walls or at workstations without any acoustical barriers. Open space noise, and in particular speech noise, is the top complaint of office workers about their offices. One reason for this is that speech enters readily into the brain's working memory and is therefore highly distracting. Even speech at very low levels can be highly distracting when ambient noise levels are low (as in the case of someone answering a telephone call in a library). Productivity losses due to speech noise have been shown in peer-reviewed laboratory studies to be as high as 41%. Office acoustic design has gotten very good at reducing ambient noise, but the quiet environments that have been created can cause speech noise to contrast strongly with the quiet. Even quiet offices, therefore, can create a level of speech intelligibility that is highly distracting. The intelligibility of speech can be measured using the Speech Transmission Index (STI).

Another major issue with open offices relates to speech privacy. Workers in open offices often feel that their telephone calls or in-person conversations can be overheard. Speech privacy correlates directly to intelligibility. Lack of speech privacy creates measurable increases in stress and dissatisfaction and is one of the top complaints of workers about their office environments.

Open office noise is typically described by workers as unpleasant and uncomfortable. Speech noise, printer noise, telephone ringer noise, and other distracting sounds increase discomfort. All of these can be summarized to three acoustic problems: (1) excessive and distracting levels of speech intelligibility, (2) lack of speech privacy, and (3) lack of acoustical comfort. All three of these problems are becoming increasingly important as office densification accelerates. The higher the utilization of office space, the more acoustical problems come to the fore. This discomfort can be measured using subjective questionnaires as well as objective measures, such as cortisol levels.

In one type of prior art, the issues associated with office noise have been attacked by facilities professionals. Noise absorbing ceiling tiles, carpeting, screens, furniture, and so on, have become the standard and office noise has been substantially decreased. Reducing the noise levels does not, however, directly solve the three problems outlined above, as they relate to the intelligibility of speech. Speech intelligibility can be unaffected, or even increased, by the noise reduction measures of facilities professionals. Another type of prior art is injecting a pink noise or filtered pink noise (herein referred to simply as "pink noise") into the open office. Pink noise is effective in reducing speech intelligibility, increasing speech privacy, and increasing acoustical comfort. However, listeners complain that pink noise sounds like an airplane environment, or complain that the constant air conditioning like sound of the pink noise becomes fatiguing over time.

As a result, improved methods and apparatuses for addressing open space noise are needed.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Figure 1:
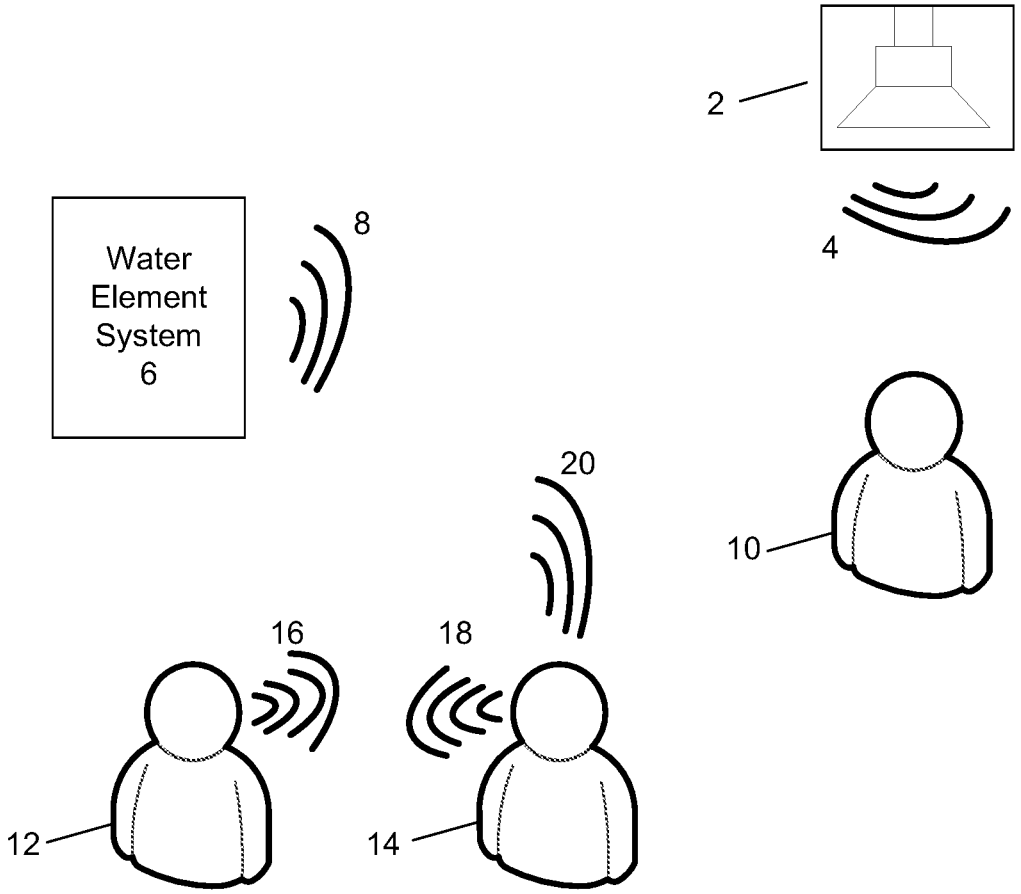
FIG. 1 illustrates a system and method for masking open space noise in one example.

Methods and apparatuses for masking open space noise are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein.

Block diagrams of example systems are illustrated and described for purposes of explanation. The functionality that is described as being performed by a single system component may be performed by multiple components. Similarly, a single component may be configured to perform functionality that is described as being performed by multiple components. For purpose of clarity, details relating to technical material that is known in the technical fields related to the invention have not been described in detail so as not to unnecessarily obscure the present invention. It is to be understood that various example of the invention, although different, are not necessarily mutually exclusive. Thus, a particular feature, characteristic, or structure described in one example embodiment may be included within other embodiments.

In one example, a method for masking open space noise includes outputting from a speaker a speaker sound corresponding to a flow of water, and displaying a water element system, the water element system generating a sound of flowing water.

In one example, a system for masking open space noise includes a speaker arranged to output a speaker sound in an open space, the speaker sound comprising a sound corresponding to a flow of water and a noise configured to mask open space noise. The system further includes a display of flowing water disposed in the open space.

In one example, a method for masking open space noise includes outputting a first masking sound to mask an open space noise in an open space, and masking an audibility of the first masking sound utilizing a second masking sound, the second masking sound operable to mask the open space noise.

In one example, a method for masking open space noise includes outputting from a speaker a speaker sound corresponding to a flow of water, outputting from the speaker a noise configured to mask open space noise, and displaying a flow of water.

In example embodiments, methods and systems are presented for noise masking in offices and call centers. The methods and systems relate to the visual and acoustic design of indoor built environments and thereby concern the fields of facilities management, architecture, acoustics, and design. Modern work environments create large open office areas that introduce highly intelligible speech noise that consequently decreases productivity, speech privacy, and acoustic comfort. Methods and systems are presented for successfully reducing the speech noise intelligibility/interference, and increasing productivity, speech privacy, and acoustic comfort.

In one example, a method and system for masking sound uses in-plenum natural water sounds combined with pink noise and a visual water element. The water sound carries significant high frequency noises that mask speech intelligibility more effectively than pink noise alone. The visual water element, i.e. the waterfall, makes workers believe that the waterfall causes their increase in comfort. Playing water sounds alone through the sound masking speakers, without a visual water element, causes discomfort among workers, who feel as though the water is dripping down from the ceiling or that it has no logical source. A logical source of the water sound is needed. The psychological effect of having the physical waterfall operate in conjunction with the masking sound is particularly advantageous. The methods and systems described provide a measurable decrease in the intelligibility of speech noise heard by workers in an open space environment. For example, such decrease can be measured using a speech transmission index (STI).

In one example, the system functions by using speakers installed in the plenum (the area between the ceiling tiles and the ceiling) to produce a masking sound that is broadcast upwards toward the ceiling. The sound is directed upwards so that it reflects off of the ceiling and is bounced back toward the ground through the ceiling tiles with increased diffusion. Creating a more diffuse sound decreases the ability of the worker to identify the location of the speakers, and eliminates the creation of "hot" and "cold" spots, where the masking sound is loud or quiet enough to be highly noticeable.

The masking sound used is a naturally occurring sound such as a natural water sound, which can be artificially generated or taken from an actual recording of water flow. In one example, actual recordings of a natural waterfall are made, then processed/equalized to a satisfactory spectrum to be most effective in masking open space noise. In one example, this water sound is mixed with electronically generated pink noise to increase the masking quality. In one example, the water sound is used alone.

In conjunction with the masking sound, a physical water element such as a waterfall feature is introduced. By having a physical water element, the workers are less able to perceive a distinct masking sound, and perceive the masking sound to be coming directly from the waterfall feature, or perhaps reverberating off of the walls and windows. In one example, a significant and effective level of sound masking (e.g., 45-48 dB) is introduced without engaging the awareness of workers in the environment. In addition to avoiding engaging the awareness of workers, this method allows the use of a natural water sound—rather than an artificial pink noise sound—for masking in an office environment. The water sound is an improvement over a pink noise system alone, both in terms of its objective performance as a masking sound and in terms of its subjective appeal—put simply, people prefer the sound of running water to pink noise. This is supported by research in biophilia, which suggests that humans have certain innate preferences for natural sounds over artificial ones. Water sound with higher frequency components are particularly effective in masking in comparison to pink noise.

In one example, a method and system provide a synergistic deployment of water sounds combined with pink noise from in-plenum speakers and a physical water wall to create the psychological perception of a natural water sound emanating from a water feature. Advantageously, the method operates without drawing attention to itself. Advantageously, the methods and systems create value to the end user by increasing his or her productivity at work while simultaneously increasing his or her comfort. Office densification is accelerating and is a major issue for most large companies. This trend is exacerbating acoustical problems and necessitating solutions to the office noise problem. Moreover, companies are increasingly focused on the productivity and comfort of their most important asset, their employees. Improving the employee experience is increasingly important for companies.

FIG. 1 illustrates a system and method for masking open space noise in one example. In one example, the system includes a speaker 2 arranged to output a speaker sound in an open space such as an office building room, the speaker sound including sound 4 corresponding to a flow of water. In one example, the sound 4 corresponding to the flow of water is a recording of a natural flow of water or an electronically synthesized sound of flow of water. In one example, the sound 4 corresponding to a flow of water has been optimized to mask open space noise. For example, a recording of the flow of water used to generate sound 4 has been processed to add 2-4 dB per octave higher frequency boost.

The system further includes a display of flowing water disposed in the open space. In the example shown in FIG. 1, the display of flowing water is a water element system 6. In one example, the water element system 6 is arranged to be easily visible within the open space.

Figure 11:
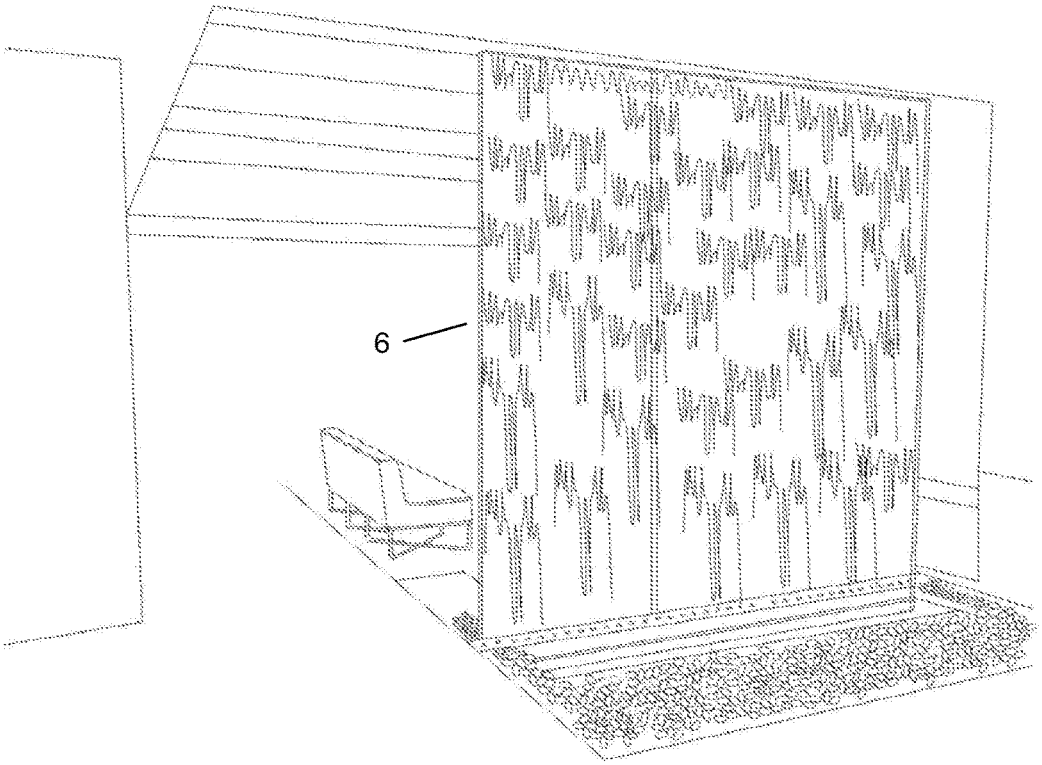
FIG. 11 illustrates the water element system shown in FIG. 1 in one example.

In one example, the water element system 6 is a floor-to-ceiling waterfall including an upper reservoir which receives water from a water supply, and a lower reservoir (e.g., a floor basin) to receive water which has fallen from the upper reservoir. The waterfall includes water recirculation tubes for recirculating water from the lower reservoir back to the upper reservoir, and a recirculation pump to recirculate the water through the recirculation tubes up to the upper reservoir. In one implementation, water falls from upper reservoir to the lower reservoir along the surfaces of one or more vertical glass panels disposed between the upper reservoir and the lower reservoir. FIG. 11 illustrates the water element system 6 shown in FIG. 1 in one example.

Figure 10:
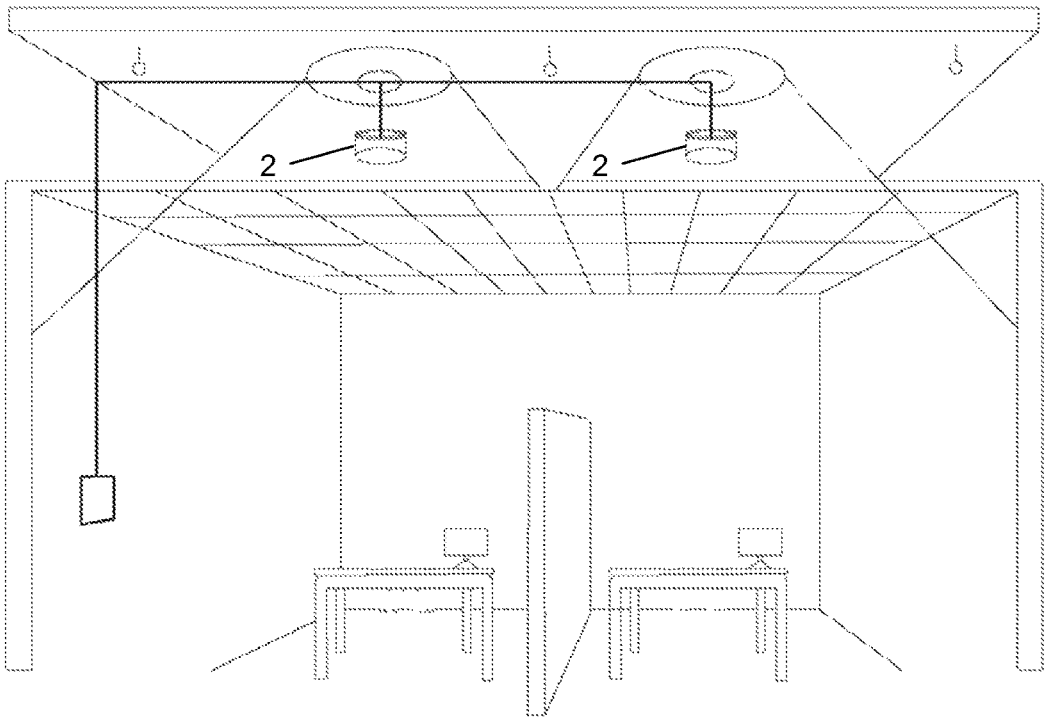
FIG. 10 illustrates placement of the speaker shown in FIG. 1 in one example.

In one example, the speaker 2 is one of a plurality of loudspeakers which are disposed in a plenum above the open space and arranged to direct the speaker sound in a direction opposite the open space. FIG. 10 illustrates placement of the speaker 2 shown in FIG. 1 in one example. The speaker sound is then reflected by the open space ceiling down into the open space. In one example, the speaker 2 is one of a plurality of speakers disposed at varying distances from the water element system 6, where an output level of the speaker sound from a speaker is adjusted based on the distance of the speaker 2 from the water element system 6. The speaker output level is adjusted so that the sound level of the flowing water (the sound 8 from the water element system 6 combined with the sound 4 of flowing water output from speaker 2) is consistent throughout the open space. At locations in close proximity to water element system 6, water sound 8 from the water element system 6 is heard. As such, the output level of a speaker 2 in close proximity to water element system 6 is reduced relative to a speaker 2 further away. In one example, sound 4 has been processed to match the frequency characteristics of water sound 8 emanating from water element system 6 so that the user is under the impression that sound 4 is emanating from water element system 6 instead of speaker 2.

In this manner, the water element system 6 may be constructed so that it need not be so loud so as to be heard throughout the open space in order for the water sound to be an effective noise masker. This reduces the possibility that workers in close proximity to the water element system 6 will find the water sound too loud and annoying while allowing workers further away to hear water sound at a sufficient level to provide effective masking of the open space noise.

Referring again to FIG. 1, in one example operation, sound 4 corresponding to the flow of water output from speaker 2 operates to mask open space noise 20 heard by a person 10. Water sound 8 from water element system 6 also operates to mask open space noise 20. In the example shown in FIG. 1, a conversation participant 12 is in conversation with a conversation participant 14 in the vicinity of person 10 in the open space. Open space noise 20 includes components of speech 16 from participant 12 and speech 18 from conversation participant 14. The intelligibility of speech 16 and speech 18 is reduced by sound 4 and sound 8.

Figure 2:
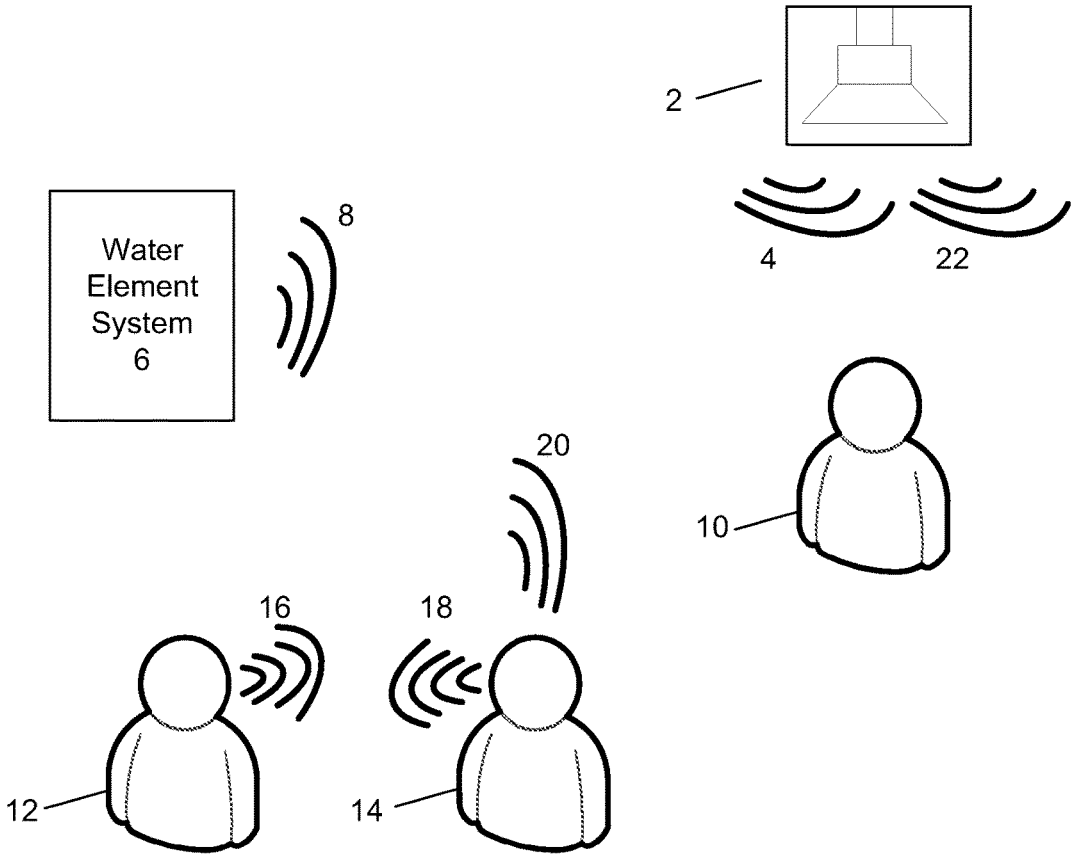
FIG. 2 illustrates a system and method for masking open space noise in a further example.

FIG. 2 illustrates a system and method for masking open space noise in a further example. In the system illustrated in FIG. 2, a sound 22 is output from speaker 2 corresponding to a noise configured to mask open space noise in addition to the sound 4 corresponding to the flow of water described in reference to FIG. 1. In one example, the noise configured to mask open space noise output from speaker 2 is a random noise such as pink noise. Both sound 4 and sound 22 operate to mask open space noise 20 heard by person 10.

In one example, the sound 4 corresponding to the flow of water is output at a sound level sufficient to partially mask or completely mask the noise sound 22. For example, this is advantageous where persons prefer to hear the sound of pink noise at a reduced level or not to hear the sound of pink noise. In one example, the output levels of sound 4 and noise sound 22 are determined experimentally and/or based on listener preference. The use of sound 4 and sound 22 produces a greater masking effect than the use of either sound 4 or sound 22 alone, while providing for increased listener comfort.

In one example, the speaker sound 4 corresponding to the flow of water is optimized to mask a higher frequency open space noise than the noise sound 22 configured to mask open space noise. For example, a frequency boost of 2-4 dB per octave is added in the processing of the recorded water sound. In this manner, noise sound 22 can be selected to mask lower frequency open space noise. For example, noise sound 22 can be selected to be a pink noise which is more appealing to be heard by persons instead of a white noise, which is slightly more effective in masking higher frequency open space noise but more unpleasant for persons to hear.

In one example, a method for masking open space noise (e.g., noise 20) includes outputting a first masking sound (e.g., sound 22, such as a pink noise) to mask an open space noise (e.g., noise 20) in an open space, and masking an audibility of the first masking sound (e.g., sound 22) utilizing a second masking sound (e.g., sound 4), the second masking sound (e.g., sound 4) also operable to mask the open space noise (e.g., noise 20). This methodology allows the level of the first masking sound (e.g., sound 22) to be increased (i.e., to produce a greater masking effect of noise 20) without being perceived by person 10. This is advantageous where person 10 finds hearing increased levels of the first masking sound by itself unpleasant.

The method further includes generating a natural sound (e.g., sound 8) associated with the second masking sound (e.g., sound 4), the natural sound generated with a water element system (e.g., water element system 6) displayed in the open space. The natural sound also operates to mask the open space noise. The presence of water element system 6 emitting sound 8 advantageously allows the use of water sound 4 to be output from speaker 2 as the person 10 has the impression that sound 4 is emanating from water element system 6.

Figure 5:
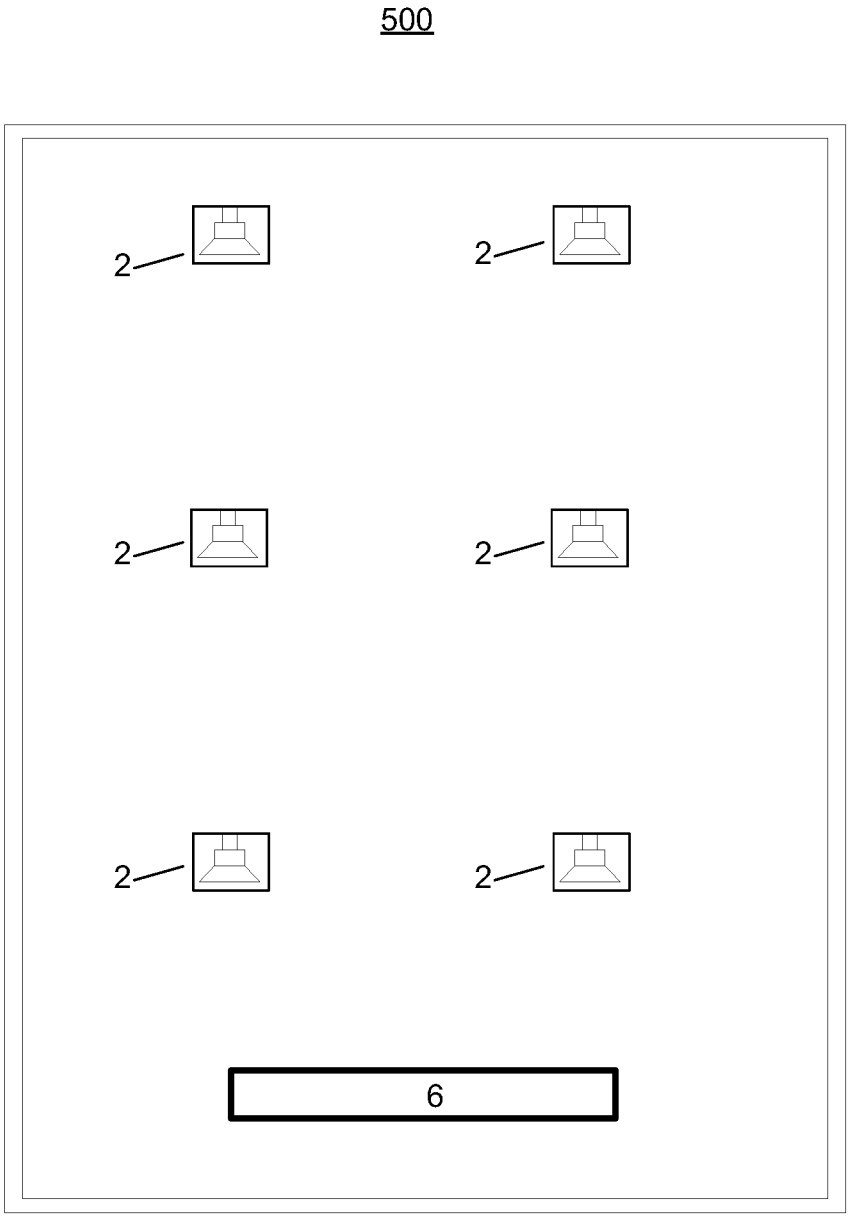
FIG. 5 illustrates placement of the speaker and the water element system shown in FIG. 1 or FIG. 2 in an open space in one example.
Figure 6:
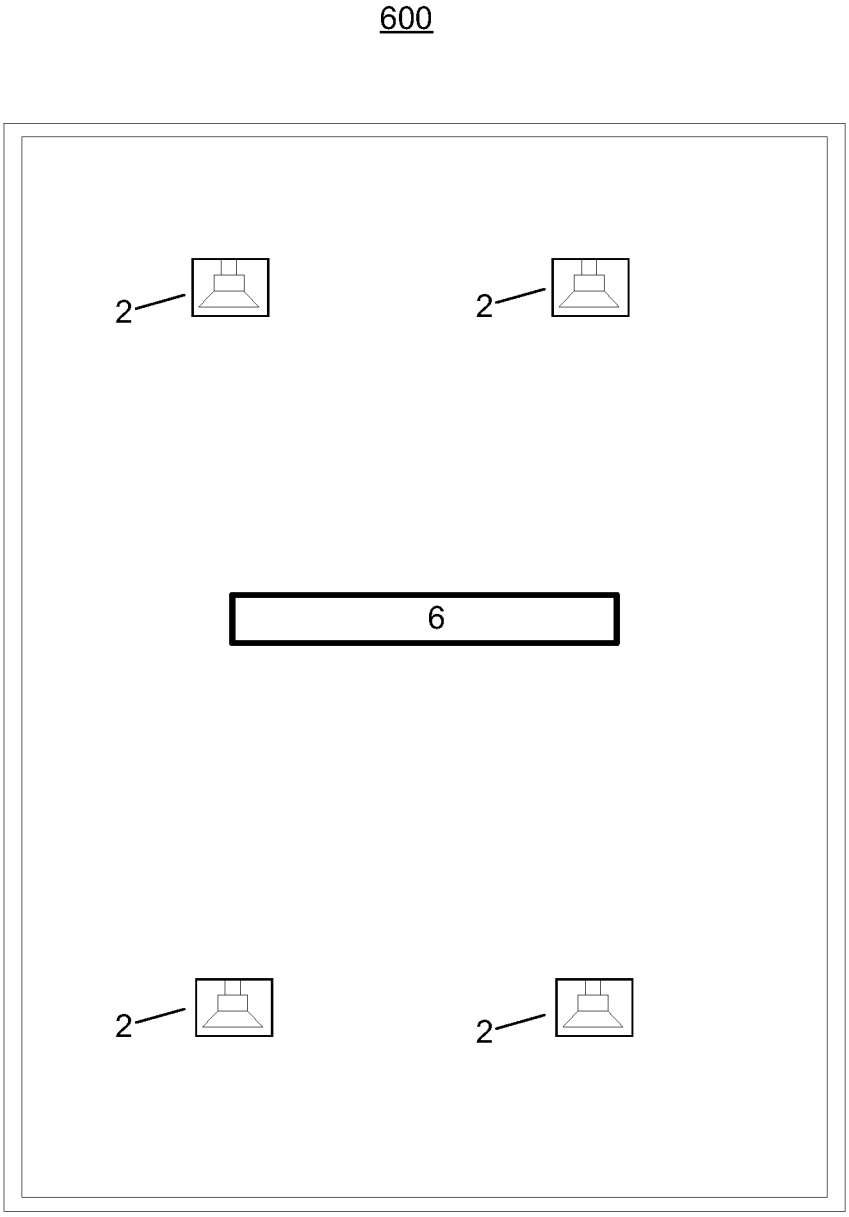
FIG. 6 illustrates placement of the speaker and the water element system shown in FIG. 1 or FIG. 2 in an open space in a further example.

FIG. 5 illustrates placement of a plurality of speakers 2 and the water element system shown in FIG. 1 or FIG. 2 in an open space 500 in one example. For example, open space 500 may be a large room of an office building in which employee cubicles are placed. FIG. 6 illustrates placement of the plurality of speakers 2 and the water element system shown in FIG. 1 or FIG. 2 in an open space 600 in a further example.

Figure 3:
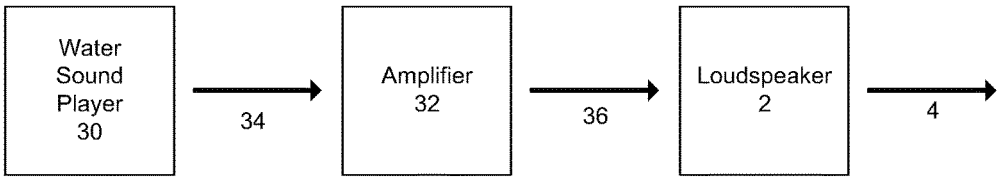
FIG. 3 illustrates a system for outputting a sound of flowing water from the speaker shown in FIG. 1 in one example.

FIG. 3 illustrates a system for outputting the sound 4 of flowing water from the speaker 2 shown in FIG. 1 in one example. A water sound player 30 outputs an audio signal 34 of a sound of flowing water. Audio signal 34 is received by an amplifier 32, which outputs an amplified audio signal 36. Amplified audio signal 36 is received by speaker 2 (e.g., a loudspeaker), which outputs the sound 4 of flowing water. In one example, water sound player 30 is an application program at a computing device. For example, the water sound player 30 may be a digital music player on a personal computer playing back an audio file containing a recording of the sound of a waterfall.

Figure 4:
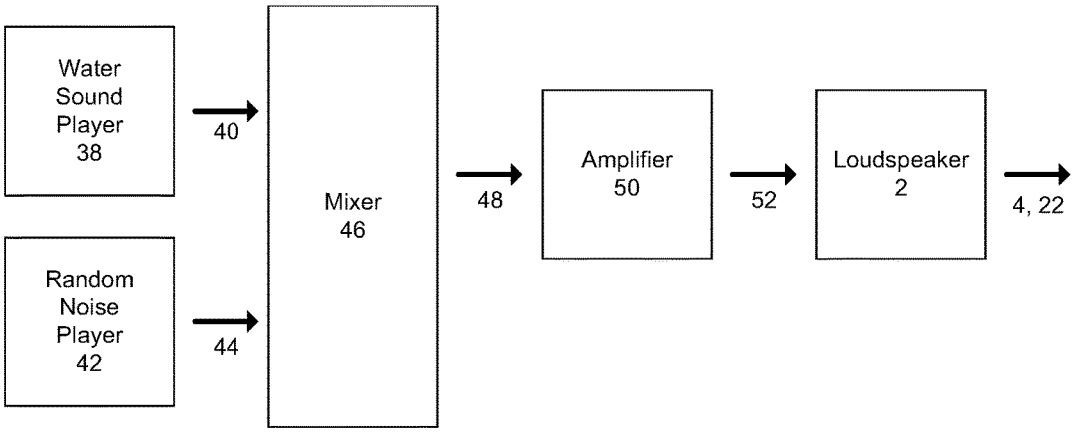
FIG. 4 illustrates a system for outputting a sound of flowing water and a noise from the speaker shown in FIG. 2 in one example.

FIG. 4 illustrates a system for outputting a sound of flowing water and a noise from the speaker 2 shown in FIG. 2 in one example. A water sound player 38 outputs an audio signal 40 of a sound of flowing water. A random noise player 42 outputs an audio signal 44 of a sound of random noise (e.g., pink noise). In one example, water sound player 38 and random noise player 42 are application programs at a computing device. Although shown as separate applications, they may be integrated into a single application, such as a digital music player playing back audio files containing a recording of the sound of a waterfall and a recording of random noise. Audio signal 40 and audio signal 44 are received at mixer 46, which outputs a mixed audio signal 48 containing both audio signal 40 and audio signal 44. Mixed audio signal 48 is received at amplifier 50, which outputs an amplified mixed audio signal 52. Amplified mixed audio signal 52 is received by speaker 2, which outputs sound 4 of flowing water and sound 22 of random noise.

Figure 7:
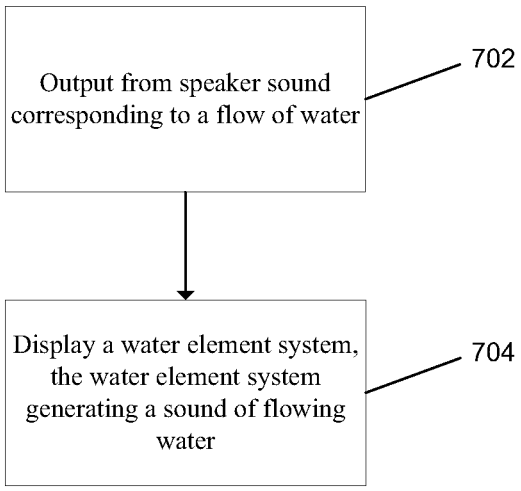
FIG. 7 is a flow diagram illustrating masking open space noise in one example.

FIG. 7 is a flow diagram illustrating masking open space noise in one example. At block 702, a speaker sound is output from a speaker corresponding to a flow of water. In one example, the speaker sound corresponding to the flow of water is a recording of a natural flow of water or an electronically synthesized sound of flow of water. In one example, the speaker sound corresponding to a flow of water has been optimized to mask open space noise. For example, a frequency boost of 2-4 dB per octave is added in the processing of the recorded water sound.

At block 704, a water element system is displayed, the water element system generating a sound of flowing water. In one example, the water element system is a waterfall.

In one example, the water element system is a waterfall disposed in an open space, and the speaker is one of a plurality of speakers comprise speakers disposed at varying distances from the waterfall. The process further includes adjusting an output level of the speaker sound corresponding to the flow of water in the plurality of speakers based on the distance of a speaker from the waterfall.

In one example, the process further includes outputting from the speaker a noise configured to mask open space noise. For example, the noise configured to mask open space noise is a pink noise. In one example, the speaker sound corresponding to the flow of water output from the plurality of speakers is output at a sound level configured to partially or completely mask the noise configured to mask open space noise. In one example, the speaker sound corresponding to the flow of water is optimized to mask a higher frequency open space noise than the noise configured to mask open space noise by adding several dB per octave higher frequency boost.

Figure 8:
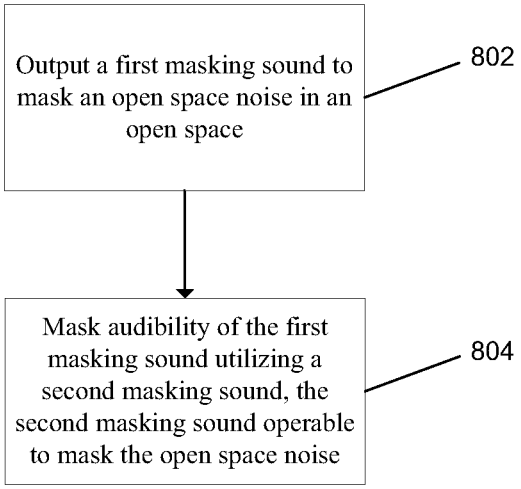
FIG. 8 is a flow diagram illustrating masking open space noise in one example.

FIG. 8 is a flow diagram illustrating masking open space noise in one example. At block 802, a first masking sound is output to mask an open space noise in an open space. At block 804, an audibility of the first masking sound is masked utilizing a second masking sound, the second masking sound operable to mask the open space noise. In one example, the first masking sound is a pink noise and the second masking sound is a sound of a flow of water. In one example, the user of the second masking sound allows for an increased level of the first masking sound without a listener noticing the increased level. In this manner, greater levels of open space noise masking are enabled while minimizing the possibility that listeners will be annoyed by hearing increased levels of the first masking noise. In one example, the first masking sound is a pink noise and the second masking sound is a natural sound comprising sounds associated with a nature environment, the nature environment comprising a rainforest. For example, the rainforest may be shown on a display screen and the sound of the rainforest output from speakers. In one example, a first masking sound level of the first masking sound or a second masking sound level of the second masking sound are changed as a function of time (i.e., modulated).

In one example, the method further includes generating a natural sound associated with the second masking sound, the natural sound generated with a visual water element system displayed in the open space. For example, the water element system is a waterfall. In one example, the natural sound operates to allow for the use of the second masking sound by providing a logical source for the second masking sound.

Figure 9:
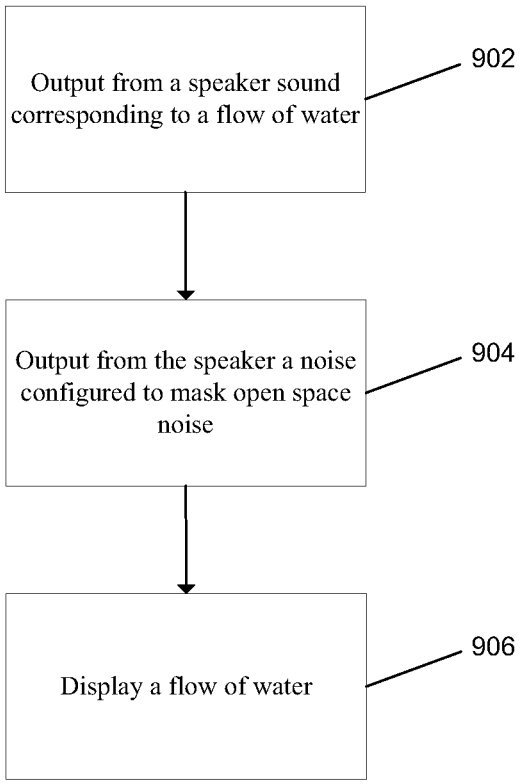
FIG. 9 is a flow diagram illustrating masking open space noise in one example.

FIG. 9 is a flow diagram illustrating masking open space noise in one example. At block 902, a speaker sound corresponding to a flow of water is output from a speaker. In one example, the speaker sound corresponding to the flow of water is a recording of a natural flow of water or an electronically synthesized sound of a flow of water. In one example, the speaker sound corresponding to the flow of water is optimized to mask a higher frequency open space noise than the noise configured to mask open space noise.

At block 904, a noise configured to mask open space noise is output from the speaker. In one example, the noise configured to mask open space noise is a pink noise. At block 906, a flow of water is displayed. In one example, the flow of water is a waterfall generating an audible sound. In a further example, the display of flowing water is a video recording of a flow of water shown on an electronic display. In one example, the speaker sound corresponding to the flow of water is output at a sound level sufficient to mask the noise configured to mask open space noise output from the speaker.

In one example, the flow of water is a waterfall disposed in an open space, and the speaker is one of a plurality of speakers disposed at varying distances from the waterfall. The process further includes adjusting an output level of the speaker sound corresponding to the flow of water in the plurality of speakers based on the distance of a speaker from the waterfall.

While the exemplary embodiments of the present invention are described and illustrated herein, it will be appreciated that they are merely illustrative and that modifications can be made to these embodiments without departing from the spirit and scope of the invention. Acts described herein may be computer readable and executable instructions that can be implemented by one or more processors and stored on a computer readable memory or articles. The computer readable and executable instructions may include, for example, application programs, program modules, routines and subroutines, a thread of execution, and the like. In some instances, not all acts may be required to be implemented in a methodology described herein.

Terms such as "component", "module", and "system" are intended to encompass software, hardware, or a combination of software and hardware. For example, a system or component may be a process, a process executing on a processor, or a processor. Furthermore, a functionality, component or system may be localized on a single device or distributed across several devices. The described subject matter may be implemented as an apparatus, a method, or article of manufacture using standard programming or engineering techniques to produce software, firmware, hardware, or any combination thereof to control one or more computing devices.

Thus, the scope of the invention is intended to be defined only in terms of the following claims as may be amended, with each claim being expressly incorporated into this Description of Specific Embodiments as an embodiment of the invention.

What is claimed is:

1. A method for masking open space noise comprising:

outputting a noise masking sound comprising a first sound of flowing water from a plurality of speakers being distributed in an open space; and reducing an adverse effect on a user hearing the first sound of flowing water from the plurality of speakers comprising displaying a water element system, the water element system generating a second sound of flowing water to mask open space noise, the second sound of flowing water combining with the first sound of flowing water in the open space.

2. The method of claim 1, wherein the water element system is a waterfall.

3. The method of claim 1, wherein the first sound of flowing water a recording of a natural flow of water or an electronically synthesized sound of flow of water.

4. The method of claim 1, wherein the first sound of flowing water has been optimized to mask open space noise.

5. The method of claim 1, wherein the water element system is a waterfall disposed in the open space, and the plurality of speakers include speakers disposed at varying distances from the waterfall, the method further comprising:

adjusting an output level of the first sound of flowing water at a speaker in the plurality of speakers based on a distance of the speaker from the waterfall.

6. The method of claim 1, further comprising outputting from the plurality of speakers a further noise masking sound comprising a pink noise.

7. The method of claim 6, wherein the first sound of flowing water is output at a sound level to mask the pink noise.

8. The method of claim 6, wherein the first sound of flowing water is optimized to mask a higher frequency open space noise than the pink noise.

9. A system for masking open space noise comprising:

a speaker arranged to output a speaker sound in an open space, the speaker sound comprising a sound corresponding to a flow of water and a noise configured to mask open space noise; and a display of flowing water disposed in the open space arranged to reduce an adverse effect on a user hearing the speaker sound comprising the sound corresponding to the flow of water and the noise configured to mask open space noise.

10. The system of claim 9, wherein the speaker is one of a plurality of speakers which are disposed in a plenum above the open space and arranged to direct the speaker sound in a direction opposite the open space.

11. The system of claim 9, wherein the display of flowing water is arranged to be visible from any location within the open space.

12. The system of claim 9, wherein the display of flowing water comprises a floor-to-ceiling waterfall arranged to be visible from anywhere within the open space to reduce the adverse effect on the user hearing the speaker sound.

13. The system of claim 9, wherein the speaker is one of a plurality of speakers disposed at varying distances from the display of flowing water, wherein an output level of the speaker sound from the speaker is adjusted based on a distance of the speaker from the display of flowing water.

14. The system of claim 9, wherein the display of flowing water comprises a video recording of a visible flow of water shown on an electronic display screen.

15. A method for masking open space noise comprising:

outputting a first masking sound at a speaker to mask an open space noise;

outputting a second masking sound comprising a sound of flowing water at the speaker to mask the first masking sound and mask the open space noise; and reducing an adverse effect on a user hearing the second masking sound comprising the sound of flowing water from the speaker comprising generating a flow of water, the flow of water emitting a water sound operable to mask the open space noise.

16. The method of claim 15, wherein the first masking sound is a pink noise and the second masking sound comprises an audio recording of the sound of flowing water.

17. The method of claim 15, wherein the first masking sound is a pink noise and the second masking sound comprises sounds associated with a nature environment, the nature environment comprising a rainforest.

18. The method of claim 15, wherein the flow of water comprises a floor-to-ceiling waterfall arranged to be visible from anywhere within an open space to reduce the adverse effect on the user hearing the second masking sound.

19. The method of claim 15, wherein a first masking sound level of the first masking sound or a second masking sound level of the second masking sound are changed as a function of time.

* * * * *